United States Patent [19]

Hedrick

[11] Patent Number: 4,724,749

[45] Date of Patent: Feb. 16, 1988

[54] CLEAN ROOM CEILING GRID SYSTEM

[75] Inventor: Geoffrey S. Hedrick, Malvern, Pa.

[73] Assignee: Donaldson Company, Inc., Minneapolis, Minn.

[21] Appl. No.: 826,142

[22] Filed: Feb. 4, 1986

[51] Int. Cl.[4] ..... F24F 7/10

[52] U.S. Cl. ..... 98/31.5; 55/355

[58] Field of Search ..... 55/355, 385 A, 417, 55/418, 473, 484; 98/31.5, 31.6, 33.1, 34.5, 34.6

[56] References Cited

U.S. PATENT DOCUMENTS 3,986,850 10/1976 Wilcox ..... 55/355

FOREIGN PATENT DOCUMENTS 26118 2/1984 Japan ..... 55/355

*Primary Examiner*—Harold Joyce

*Attorney, Agent, or Firm*—Merchant, Gould, Smith, Edell, Welter & Schmidt

[57] ABSTRACT

A system for providing a hermetically sealed clean room environment (34) from which air enters through a filter (20, 20*a*) includes a magnetically permissive ceiling grid (22, 26, 54), a filter panel (20, 20*a*) removably mountable in the grid (22, 26, 54) and a magnetic sealing and mounting arrangement (38, 40, 42, 44, 52) associated with the filter panel (20, 20*a*) for effectuating an airtight/particle-tight hermetic seal. A permanent magnet (42, 52) extends circumferentially around the periphery of the filter panel (20, 20*a*) and is bonded thereto, with the magnet (42) being embedded in a gasket (38) in one instance and comprising a magnet blade (52) in another instance. In either instance, a magnetically flowable fluid is disposed between the magnet (42, 52) and the ceiling grid (22, 54) so that when the panel (20, 20*a*) is placed into the steel ceiling grid (22, 54), a high reluctance path is set up in the air space between the magnet (42, 52) and the steel grid (22, 54) and the magnetic lines of flux (50, 60)travel through the fluid (44) to the ceiling grid (22, 54) as a return path. The fluid (44) aligns itself with these magnetic lines of flux (50, 60) in an attempt to reduce the magnetic reluctance of the circuit and in so doing fills all the voids (45) between the filter panel and the grid mounting interface (38-22, 52-54). The resulting hermetic seal permits the plenum (24) above the dropped ceiling (26) to be positively pressurized by an air blower (28) to provide the clean room environment (34).

9 Claims, 7 Drawing Figures

FIG. 1
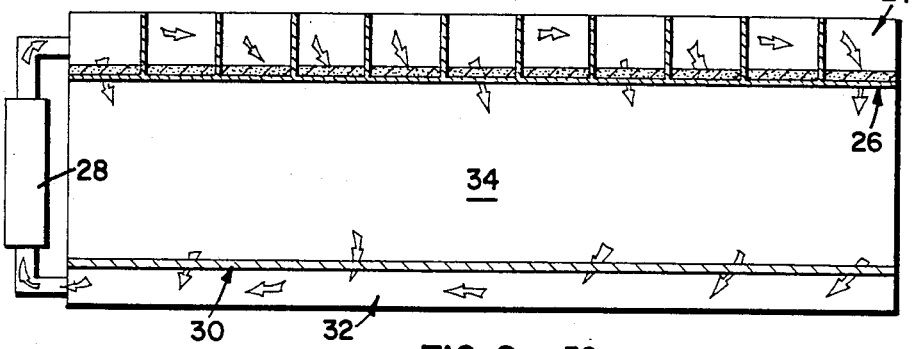
FIG. 2
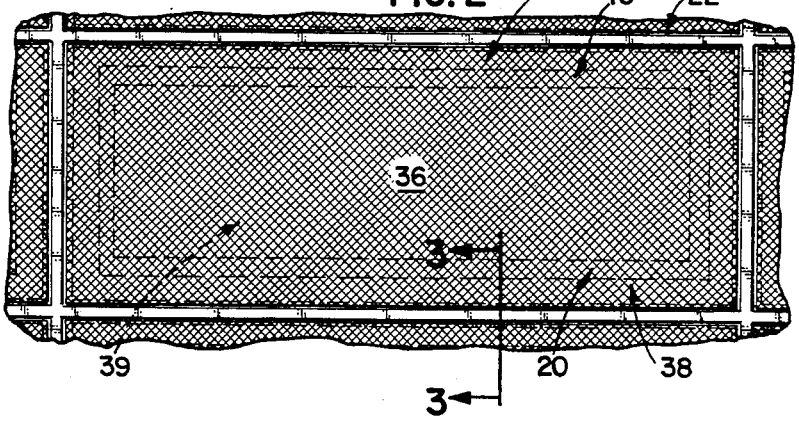
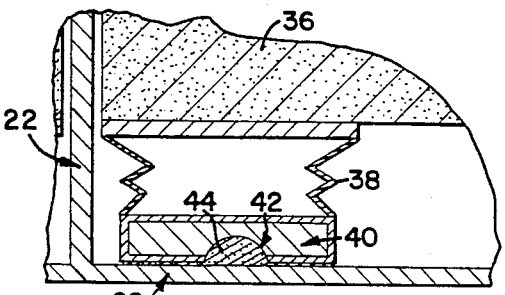
FIG. 3
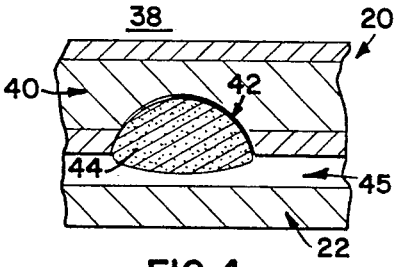
FIG. 4
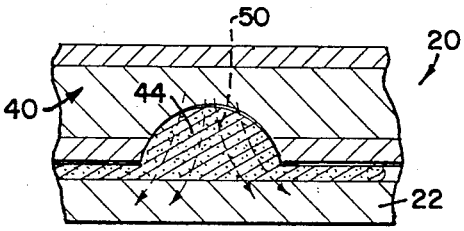
FIG. 5

CLEAN ROOM CEILING GRID SYSTEM

TECHNICAL FIELD

The present invention relates to systems for providing an airtight/particle-tight hermetically sealed clean room environment from which air enters through a filter, and particularly to such systems in which a panel supporting grid system, such as a ceiling grid, is employed in a clean air management system.

BACKGROUND OF THE INVENTION

Clean room environments in which ceiling grids containing filter panels are employed are well known in the art. Such systems generally employ dropped ceilings above which is a plenum from which air passes through the filter panels in the ceiling grid into the clean room. Normally, in a clean room environment, it is imperative to achieve a hermetic seal for the filter panels in the ceiling grid since the particulate count in the room must normally be maintained at 10 particulates per cubic foot or less even though the air above the plenum often contains as many as 100,000 particulates, even under ideal conditions. In an attempt to provide such a hermetic seal so that no air can leak around the filter panels where they contact the supporting ceiling grid, prior art techniques have employed the mounting of filter panels in troughs filled with a Vaseline like substance in an effort to provide a hermetic type seal while allowing the filter panel to be readily removed for access or replacement. Such an arrangement has proved both costly and messy. Moreover, although the use of magnetic sealing fluids is known with respect to high speed rotating shafts, such a fluid, such as Ferrofluid, which is a commercially available collodial suspension of ferric oxide, has not been employed in connection with ceiling grids nor with such grids in a clean room environment. Prior art sealing techniques which have been employed to prevent particulate migration have not proved satisfactory from applicants' point of view. These disadvantages of the prior art are overcome by the present invention.

DISCLOSURE OF THE INVENTION

A system for providing an airtight/particle-tight hermetically sealed clean room environment into which air is passed through a filter comprises a panel supporting grid member, such as a ceiling grid, with the grid member comprising a circumferential mounting frame having an aperture therein, a filter panel, with the frame being capable of mounting the filter panel therein in hermetically sealing engagement forclosing the aperture, with the filter comprising a filter screen disposable across the aperture for filtering the air therethrough, and magnetic sealing and mounting means circumferentially extending around the periphery of the filter panel for mounting the filter panel to the frame in the aforementioned hermetically sealing engagement. The frame comprises a magnetically permissive material such as preferably steel. The filter panel magnetic sealing and mounting means preferably comprises a permanent magnet disposed about the filter panel periphery for providing associated lines of magnetic flux radiating substantially from a plane substantially normal to the plane of the frame in which the filter panel is mounted. This permanent magnet can either be, by way of example, a rubber permanent magnet embedded in a gasket which is bonded to the filter screen or, when no gasket is utilized, can comprise a magnet blade, with the frame in such an instance comprising a steel channel in which the magnetic blade is inserted for mounting the filter panel to the frame. In either instance, a magnetically flowable fluid, such as a colloidal suspension of ferric oxide, such as commercially available under the designation Ferrofluid, is disposable in an air gap or void between the mounting frame and the permanent magnet means about the filter panel periphery.

The connection between the permanent magnet and the magnetically permissive mounting frame develops a high reluctance path through the air gap between the permanent magnet and the magnetically permissive mounting frame, with the mounting frame providing a return path for the magnetic flux through the magnetically flowable fluid. When the filter panel is mounted in the frame or grid, the magnetically flowable fluid flows in the air gap and aligns itself along the associated lines of magnetic flux in the high reluctance path for providing a hermetically sealed engagement between the filter panel and the mounting frame. Where a gasket is employed in which a permanent magnet is embedded, the gasket preferably includes a longitudinal cavity extending therealong, with the magnetically flowable fluid being disposed in the gasket cavity which opens to the mounting frame and is beneath the permanent magnet. The magnetically flowable fluid, in such an instance, is retainable in the gasket cavity by the permanent magnet and flows therefrom into the air gap in the high reluctance path when the filter panel is mounted to the frame and back into the cavity when the filter panel is dismounted from the frame. Where a permanent magnet blade is employed instead of the gasket arrangement, the magnetically flowable fluid is disposed in the frame channel beneath the insertable magnet blade, with the channel comprising a trough for retaining the magnetically flowable fluid therein and flowing therein into the air gap in the high reluctance path when the filter panel is mounted to the frame and being retained in the trough when the filter panel is dismounted from the frame. As a result of the airtight/particle-tight hermetic seal of the present invention, the plenum above the ceiling may be positively pressurized, such as by using a high volume air blower arrangement. Similarly, the hermetic seal of the present invention may be employed to hermetically seal filter panels in the clean room walls.

BRIEF DESCRIPTION OF THE DRAWINGS

FIG. 1 is a diagrammatic illustration of a clean room environment employing the concept of the present invention;

FIG. 2 is an enlarged fragmentary plan view of a typical mounted filter panel in the ceiling grid of the clean room environment of FIG. 1 in accordance with the present invention;

FIG. 3 is an enlarged fragmentary sectional view taken along line 3—3 of FIG. 2 showing the gasket bonded to the filter although, the gasket may be bonded to the ceiling grid frame instead if desired;

FIG. 4 is an enlarged fragmentary diagrammatic illustration of the filter panel-ceiling grid frame arrangement of FIG. 3 illustrating the filter panel before it becomes seated or mounted on the frame;

FIG. 5 is an enlarged fragmentary diagrammatic illustration similar to FIG. 4 showing the filter panel after it has been seated in the frame of the embodiment shown in FIG. 1;

BEST MODE FOR CARRYING OUT THE INVENTION

Figure 6:
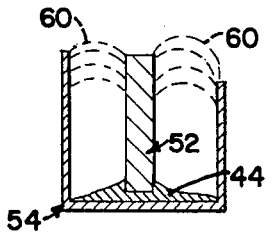
FIG. 6 is an enlarged fragmentary diagrammatic illustration an alternative embodiment of the ceiling grid - filter panel arrangement of FIGS. 2-5 for providing a hermetically sealed clean room environment in accordance with the present invention.

Referring now to the drawings in detail, and initially to FIGS. 1 through 5 thereof, the presently preferred embodiment of the present invention is shown. As will be explained in greater detail hereinafter, FIG. 1 illustrates a gasket sealing system in which a plurality of the presently preferred embodiment of filter panels 20, illustrated in greater detail in FIGS. 2 through 5, are mounted in a ceiling grid panel or frame 22 of a dropped ceiling 26 which, as will be explained in greater detail hereinafter, is preferably composed of a magnetically permissive material, such as preferably steel. The filter panels 20 of the present invention in conjunction with the ceiling grid 22 provide a hermetically sealed clean room environment 34 and seal the plenum 24 above the dropped ceiling 26 to provide a clean room by filling the ceiling grid 22 with the presently preferred filter panels 20 and pressurizing the plenum 24 above the dropped ceiling 26 with a conventional air blower 28, such as a high volume air blower, designed to provide a positive pressure plenum with respect to a given room size. Preferably, as shown and preferred in FIG. 1, a false floor 30 is provided in the clean room environment so as to provide a plenum 32 below the floor for the passage of return air, with the blower 28 being connected in flowthrough communication between the positive pressure plenum 24 and the return air plenum 32 as illustrated in FIG. 1. The air above the positive pressure plenum 24 in a clean room environment can normally contain as many as 100,000 particulates even under ideal conditions, with the hermetic seal preferably maintaining the particulate count in the clean room 34 substantially at 10 particulates per cubic foot or less.

FIGS. 2 through 5 illustrate the presently preferred embodiment of a typical filter panel 20 mounting arrangement in accordance with the airtight/particle-tight hermetic sealing arrangement of the present invention. As shown and preferred in FIG. 2, a typical filter panel 20 preferably contains a conventional filter screen area 36 which spans the aperture formed in each of the ceiling grid members 22 comprising the dropped ceiling 26, as will be described in greater detail hereinafter with reference to FIGS. 3 through 5. Preferably, a magnetic gasket seal 38 is adhesively bonded to the filter 36 frame along the periphery thereof and circumferentially extends around the periphery as illustrated in FIG. 2. The gasket 38, such as one compound of PVC or rubber, preferably has embedded therein a conventional permanent rubber magnet 40 which longitudinally extends along the gasket, thereby circumferentially extending around the periphery of the filter panel 20. As further shown and preferred, the bottom of the gasket 38 preferably contains a longitudinal cavity or pocket 42 running along the length of the gasket 38 approximately in the center and beneath permanent magnet 40. As shown and preferred in FIGS. 3 through 5, a film of magnetically flowable fluid 44, such as a colloidal suspension of ferric oxide commercially available under the name Ferrofluid, is retained in the longitudinal cavity 42 by flux from the permanent magnet 40 embedded in the rubber gasket 38.

FIG. 4 illustrates the position of the filter panel 20 immediately before being seated or mounted to the supporting frame or ceiling grid 22. At this point there is a gap or void 45 between the bottom of the gasket 38 in which the rubber magnet 40 is embedded and the frame 22, with the magnetically flowable fluid 44 being retained in the cavity 42 by the magnet 40. FIG. 5 illustrates the position when the filter panel 20 is mounted or placed into the steel ceiling grid 22 to seat the panel 20 in the grid 22. When the panel 20 is placed in the steel ceiling grid 22, a high reluctance path is set up in the air space or gap 44 between the magnet 40 and the steel grid 22, with the steel grid 22 acting as a return path for the lines of flux in the high reluctance path which has been set up. The magnetic lines of flux, represented by reference numeral 50 in FIG. 5, travel through the magnetically flowable fluid 44 to the ceiling grid 22 as a return path, with the fluid 44 aligning itself with these magnetic lines of flux in an attempt to reduce the magnetic reluctance of the circuit. In so doing, as illustrated in FIG. 5, the magnetic fluid 44 fills all the voids between the gasket 38 and the ceiling grid 22 to provide a hermetic seal which prevents particulate migration. When the filter panel 20 is removed from the steel ceiling grid 22, the magnetically flowable fluid 44 is again drawn by the magnetic field set up by the magnet 40 back into the longitudinal cavity 42 in the gasket 38, once again returning to the configuration illustrated in FIG. 4. As was previously mentioned with reference to FIG. 1 with the arrangement of FIGS. 1 through 5, an airtight/particle-tight hermetic quality seal is provided for the dropped ceiling 26 of the clean room environment 34, and the plenum 24 can be positively pressurized to provide a large low cost high quality clean room.

Figure 7:
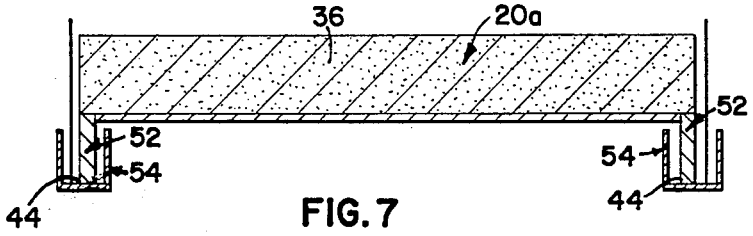
FIG. 7 is an enlarged fragmentary diagrammatic illustration of the embodiment of FIG. 6 showing the hermetically sealing engagement between the mounted filter panel and the supporting frame or grid work.

Referring now to FIGS. 6 and 7, the primary difference between this embodiment and the embodiment described with reference to FIGS. 2 through 5, is that the hermetic seal is accomplished by means of a magnet blade 52 extending circumferentially around the periphery of the filter panel 20*a*, as opposed to the gasket-embedded magnet - cavity arrangement 38-40-42 of FIGS. 2 through 5, with the magnetically flowable fluid 44, in this instance, preferably being located in a channel 54 of the ceiling grid 54, as opposed to in the longitudinal cavity 42 of the gasket 38 as in the embodiment of FIGS. 2 through 5. Thus, in the embodiment of FIGS. 6 and 7, a film of the magnetically flowable fluid 44 is preferably retained in the ceiling grid channel 54. When the filter panel 20*a* which has the magnet blade 52 extending around the periphery thereof is inserted in the channel 54, the magnetic lines of flux, represented by reference numeral 60, travel through the fluid 44 to the steel ceiling grid 54 as a return path with, once again a high reluctance path being set up in the air space between the magnet 52 and the steel grid 54. As was true with respect to the embodiment of FIGS. 2 through 5, the magnetically flowable fluid 44 aligns itself with these magnetic lines of flux in an attempt to reduce the magnetic reluctance of the circuit and, in so doing, fills all voids between the magnet 52 and the grid 54 to provide a hermetic seal preventing particulate migration. When the filter panel 20*a* is removed, the fluid 44 again distributes itself in the channel 54 where it remains. In either instance, the magnet 40 or 52 provides associated lines of magnetic flux radiating substantially from a plane substantially normal to the plane of the frame 22 or 54 in which the filter panel 20 or 20a is mounted. It should be noted that the filter panel 20a - channel 54 arrangement of FIGS. 6 and 7 may readily be substituted for the filter panel 20 - grid 22 arrangement in the clean room environment of FIG. 1 to provide a clean room by filling the ceiling 26 with the filter panels 20 or 20a and pressurizing the plenum 24 above with the above with the air blower 28.

Although the filter panel-grid hermetic sealing arrangement of the present invention has been described with respect to a ceiling grid system, it should be noted that it can also be employed in hermetically sealing any of the walls of the clean room in which a filter panel is inserted. Thus, by utilizing the present invention, an airtight/particle-tight hermetically sealed clean room environment, which may be easily maintained, is provided.

What is claimed is:

1. A system for providing an airtight/particle tight hermetically sealed clean room environment from which air is passed through a filter, said system comprising a panel supporting grid member, said grid member comprising a circumferential mounting frame having an aperture therein, a filter panel, said frame being capable of mounting said filter panel therein in hermetially sealing engagement therewith for closing said aperture, said mounted filter panel comprising a filter screen disposable across said aperture for filtering said exhausted air therethrough and magnetic sealing and mounting means circumferentially extending around the periphery of said filter panel for mounting said filter panel to said frame in said hermetically sealing engagement, said frame comprising a magneticly permissive material, said filter panel magnetic sealing and mounting means comprising permanent magnet means disposed about said filter panel periphery for providing associated lines of magnetic flux radiating substantially from a plane substantially normal to the plane of the frame in which said filter panel is mounted; said magnetic sealing and mounting means further comprises a gasket member bonded to said filter screen, said permanent magnet means being disposed in said gasket; and a magnetically flowable fluid disposable in an air gap between said frame and said permanent magnet means about said filter panel periphery, said permanent magnet means and said magnetically permissive mounting frame comprising a high reluctance path through said air gap between said permanent magnet means and said magnetically permissive mounting frame, said mounting frame providing a return path for said high reluctance path through said magnetically flowable fluid, said magnetically flowable fluid flowing said air gap and aligning itself along said associated lines of magnetic flux in said high reluctance path for providing said hermetically sealing engagement between said filter panel and said mounting frame; said gasket member including a longitudinal cavity extending along said magnetic sealing and mounting means, said magnetically flowable fluid being disposed in said gasket cavity, said gasket cavity opening to said mounting frame and being beneath said permanent magnet means, said magnetically flowable fluid being retainable in said gasket cavity by said permanent magnet means and flowing therefrom into said air gap in said high reluctance path when said filter panel is mounted to said frame and back into said cavity when said filter panel is dismounted from said frame; whereby said airtight/particle tight hermetically sealed clean room environment is provided.

2. A system in accordance with claim 1 wherein said mounting frame is comprised of steel.

3. A system in accordance with claim 2 wherein said permanent magnet means comprises a rubber permanent magnet embedded in said gasket.

4. A system in accordance with claim 1 wherein wherein said permanent magnet means comprises a rubber permanent magnet embedded in said gasket.

5. A system in accordance with claim 1 wherein said filter panel and said grid member comprise a hermetically sealed dropped ceiling for said clean room environment for providing a pressurizable plenum above said dropped ceiling, said system further comprising means for positively pressurizing said plenum.

6. A system in accordance with claim 5 wherein said means for positively pressurizing said plenum comprises an air blower means.

7. A system in accordance with claim 6 wherein said clean room environment comprises a raised floor and means for providing a return air path to said pressurizable plenum.

8. A system in accordance with claim 5 wherein said means for positively pressurizing said plenum comprises a high volume air blower means.

9. A system in accordance with claim 8 wherein said clean room environment comprises a raised floor and means for providing a return air path to said pressurizable plenum.

* * * * *

UNITED STATES PATENT AND TRADEMARK OFFICE

CERTIFICATE OF CORRECTION

PATENT NO. : 4,724,749

DATED : February 16, 1988

INVENTOR(S) : Geoffrey S. Hedrick

It is certified that error appears in the above-identified patent and that said Letters Patent is hereby corrected as shown below:

Column 1, line 52, "forclosing" should be --foreclosing--;

Column 3, line 2, after "illustration" insert --of--;

Column 5, line 11, delete "above with the";

Column 5, line 28-29, "hermetially" should be --hermetically--;

Column 5, line 36, "magneticly" should be --magnetically--.

Signed and Sealed this

Twentieth Day of December, 1988

*Attest:*

*Attesting Officer*

DONALD J. QUIGG

*Commissioner of Patents and Trademarks*